US006409116B1

(12) United States Patent
Brown

(10) Patent No.: US 6,409,116 B1
(45) Date of Patent: Jun. 25, 2002

(54) RAPIDLY ADJUSTABLE WIRE CONTROL MECHANISM

(75) Inventor: Maurice H. Brown, 502 W. Main, Albion, NE (US) 68620

(73) Assignee: Maurice H. Brown, Albion, NE (US)

( * ) Notice: Subject to any disclaimer, the term of this patent is extended or adjusted under 35 U.S.C. 154(b) by 43 days.

(21) Appl. No.: 09/698,408

(22) Filed: Oct. 30, 2000

(51) Int. Cl.[7] ..... B65H 59/10; B65H 54/553; B65H 23/06

(52) U.S. Cl. ..... 242/419.1; 242/128; 242/129.8; 242/421.7

(58) Field of Search ..... 242/128, 129.8, 242/419, 419.1, 419.8, 420.6, 420.7

(56) References Cited

U.S. PATENT DOCUMENTS

| | | | | |
|---|---|---|---|---|
| 3,202,380 A | * | 8/1965 | Hosbein | 242/128 |
| 3,632,062 A | * | 1/1972 | Sole | 242/129.8 |
| 3,990,652 A | | 11/1976 | Brown | |
| 3,995,786 A | * | 12/1976 | Deniega | 242/128 |
| 4,298,174 A | * | 11/1981 | Kovaleski | 242/128 |
| 5,040,741 A | * | 8/1991 | Brown | 242/129.8 |

* cited by examiner

*Primary Examiner*—Michael R. Mansen

(74) *Attorney, Agent, or Firm*—Cook, Alex, McFarron, Manzo, Cummings & Mehler, Ltd.

(57) ABSTRACT

A wire tensioning device for maintaining tension on a moving wire, especially a wire that is uncoiled over the axial end of a fixed spool of wire. The tensioning device includes a disk mounted at an axial end of a spool of wire. The disk has a plurality of radially extending resistant filaments that protrude beyond the periphery of the axial end of the spool of wire. The filaments engage the wire as it is unwound from the spool over the axial end thereof to apply a resistance to the uncoiling of the wire. A drive shaft powered by a reversible electric motor connects to the disk which motor rapidly responds to changes in resistance applied to the uncoiling wire by the bending or unbending of the filaments. An arm is engaged by the uncoiling wire. The arm is connected to a rotatably mounted axle for movement in a limited arc. A rotor is formed on the axle with the rotor having a lobe. A pair of proximity switches for operating the reversible electric motor in opposite directions of rotation are provided. One of the pair of proximity switches is positioned on each of diametrically located opposite sides of the rotor. The proximity switches are positioned relative to the rotor to locate the lobe in actuating proximity to only one of the pair of proximity switches during rotation of the axle in response to pivotal movement of the arm. An indicator arm is attached to the motor drive shaft and moves in an arc. Limit switches are located at the opposite ends of the arc to control the flow of electricity to the reversible motor.

2 Claims, 4 Drawing Sheets

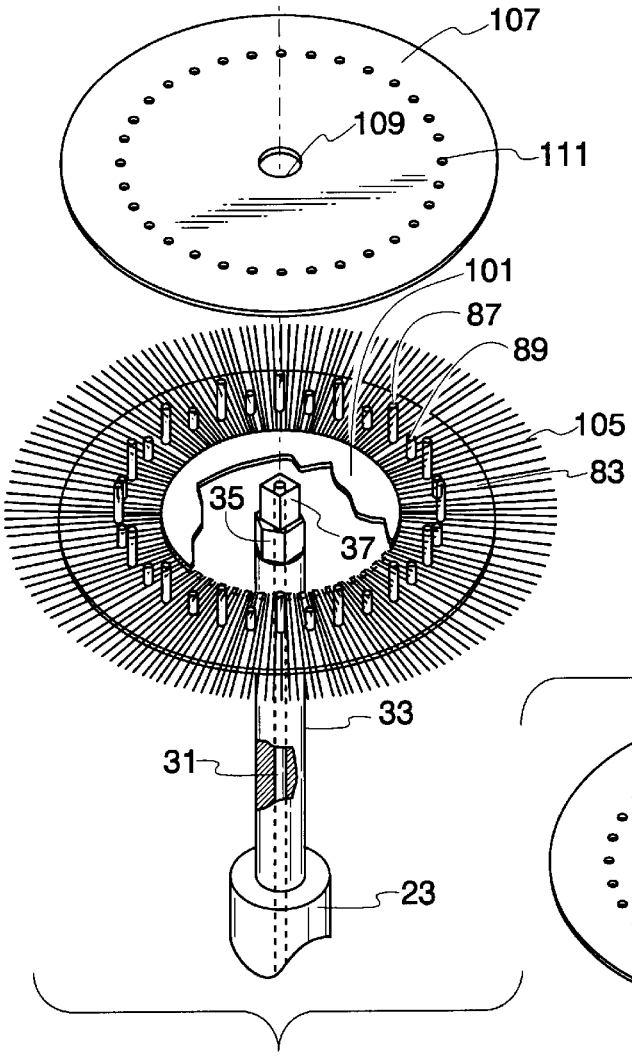
Fig. 3
Fig. 4
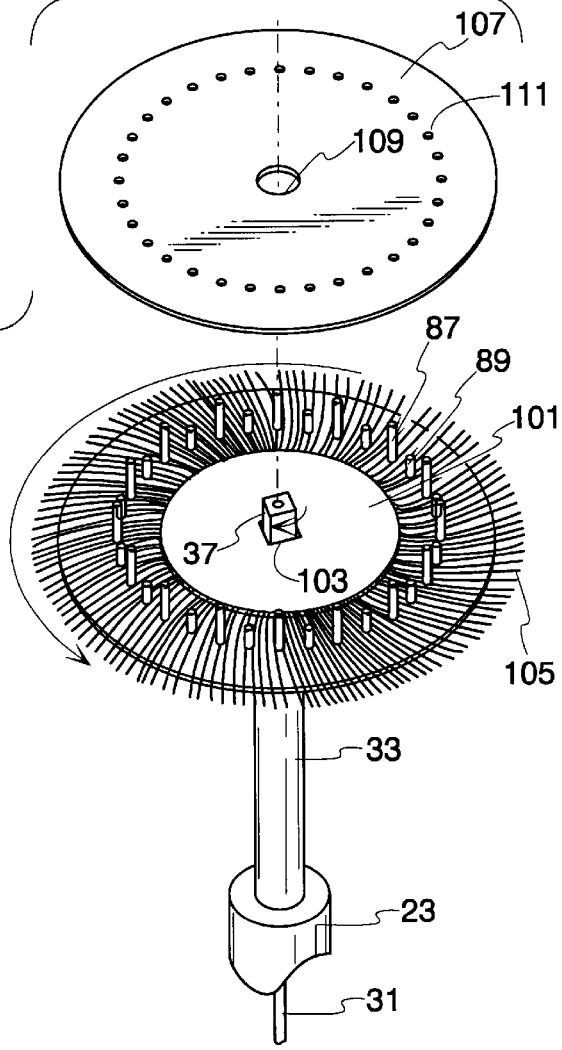

RAPIDLY ADJUSTABLE WIRE CONTROL MECHANISM

BACKGROUND AND SUMMARY OF THE INVENTION

This invention is directed to an apparatus for maintaining tension on a moving wire, especially a wire that is uncoiled over the axial end of a fixed spool of wire. An apparatus using a mechanical mechanism for automatically maintaining a generally uniform tension on a moving wire as the speed of the wire varies is shown in my U.S. Pat. No. 3,990,652, issued Nov. 9, 1976, which patent is incorporated herein by reference in its entirety. The apparatus shown in my said patent has been commercially successful maintaining tension on uncoiling wires having diameters of approximately 40 A.W.G. and larger. However, when uncoiling wire of a finer gauge, i.e., wire having a diameter of 55 A.W.G. and smaller diameters, the apparatus of my said patent does not respond quickly enough to changes in tension applied to the uncoiling wire because of the high inertia of the mechanical components of the apparatus of my said patent.

Accordingly, an object of this invention is an apparatus for maintaining tension on a moving, uncoiling wire wherein the bending and unbending of the filaments for tensioning the wire respond more quickly to changes in the speed of the uncoiling wire.

Another object of this invention is an apparatus for maintaining tension on a moving, uncoiling wire through the use of an electric motor whose direction of rotation can be rapidly changed.

Other objects and features of this invention will be found in the following specification, claims and drawings.

BRIEF DESCRIPTION OF THE DRAWINGS

The invention is illustrated more or less diagrammatically in the following drawings wherein:

FIG. 3 is an enlarged, exploded view of a portion of the filament bending mechanism with parts broken away;

FIG. 4 is an exploded view similar to FIG. 3 with the filaments shown in slightly bent positions;

DESCRIPTION OF THE PREFERRED EMBODIMENTS

Figure 1:
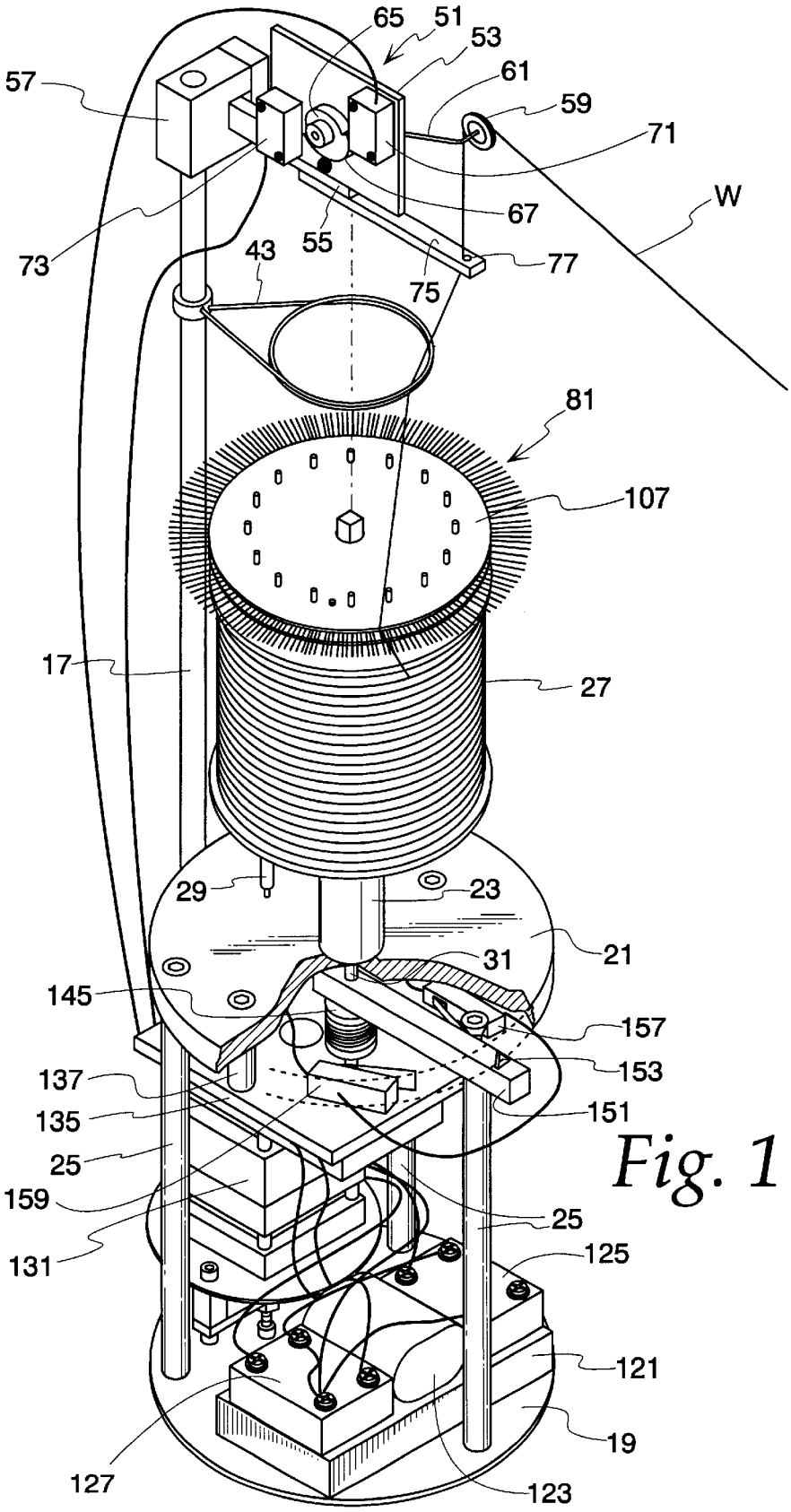
FIG. 1 is a prospective view of the apparatus incorporating the novel features of this invention with some parts broken away for clarity of illustration.
Figure 2:
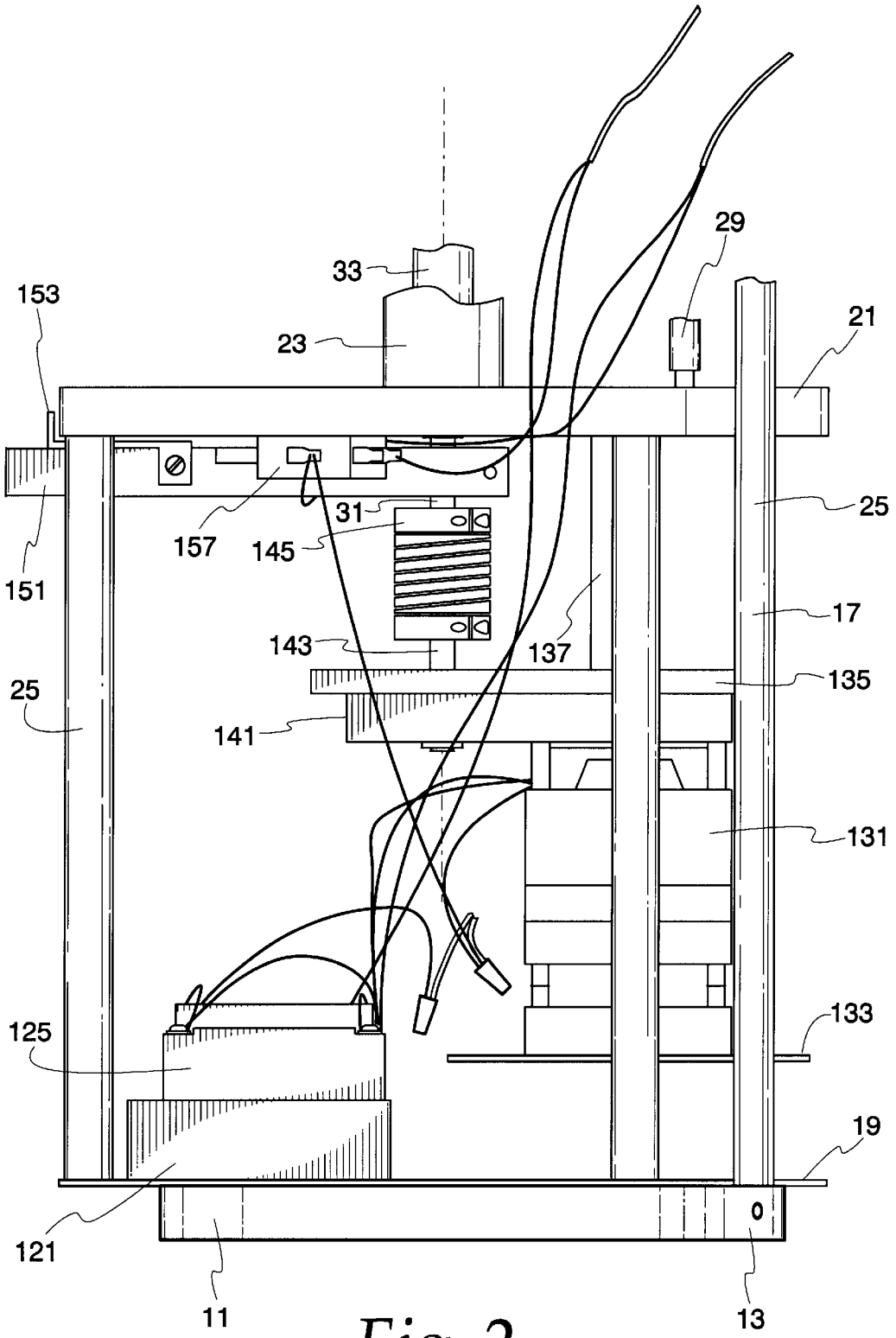
FIG. 2 is an enlarged, partial side elevational view of the lower portion of the apparatus shown in FIG. 1.

An apparatus embodying the novel features of this invention is shown in FIGS. 1 and 2 of the drawings. The apparatus includes a base 11 (FIG. 2) having an integral post mount 13. The post mount includes a post socket (not shown) alongside. A post 17 fits in the post socket of the post mount 13 and extends upwardly of the apparatus. Mounted on the base 11 is a circular base plate 19. Located above the base plate 19 is a support plate 21 for a wire spool support post 23. Three support posts 25 extend between the circular base plate 19 and the support plate 21. These posts are evenly spaced around the periphery of the base plate 19. A spool 27 of wire W is supported on the wire spool support post 23. A stub post 29 to prevent rotation of the spool 27 is also seated on the plate 21 and engages the spool 27.

As shown most clearly in FIGS. 1, 3 and 4 of the drawings, a twist shaft 31 extends through a tube 33 which in turn passes through the wire spool support post 23 and wire spool 27 and is supported on the support plate 21. A hexagonal head 35 is formed on the upper end of tube 33. The twist shaft 31 extends above this hexagonal head 35 and a square head 37 is affixed to the upper end of the shaft 31.

Figure 5:
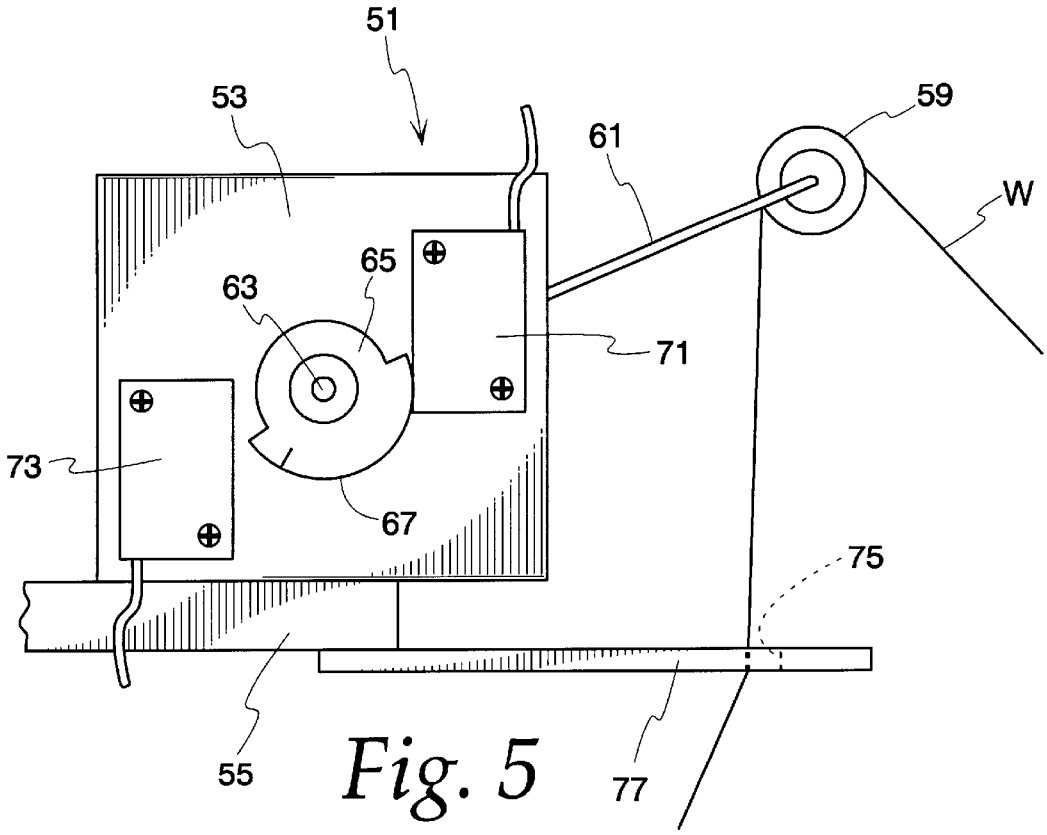
FIG. 5 is an enlarged, partial view of the tension sensing mechanism of this invention.
Figure 6:
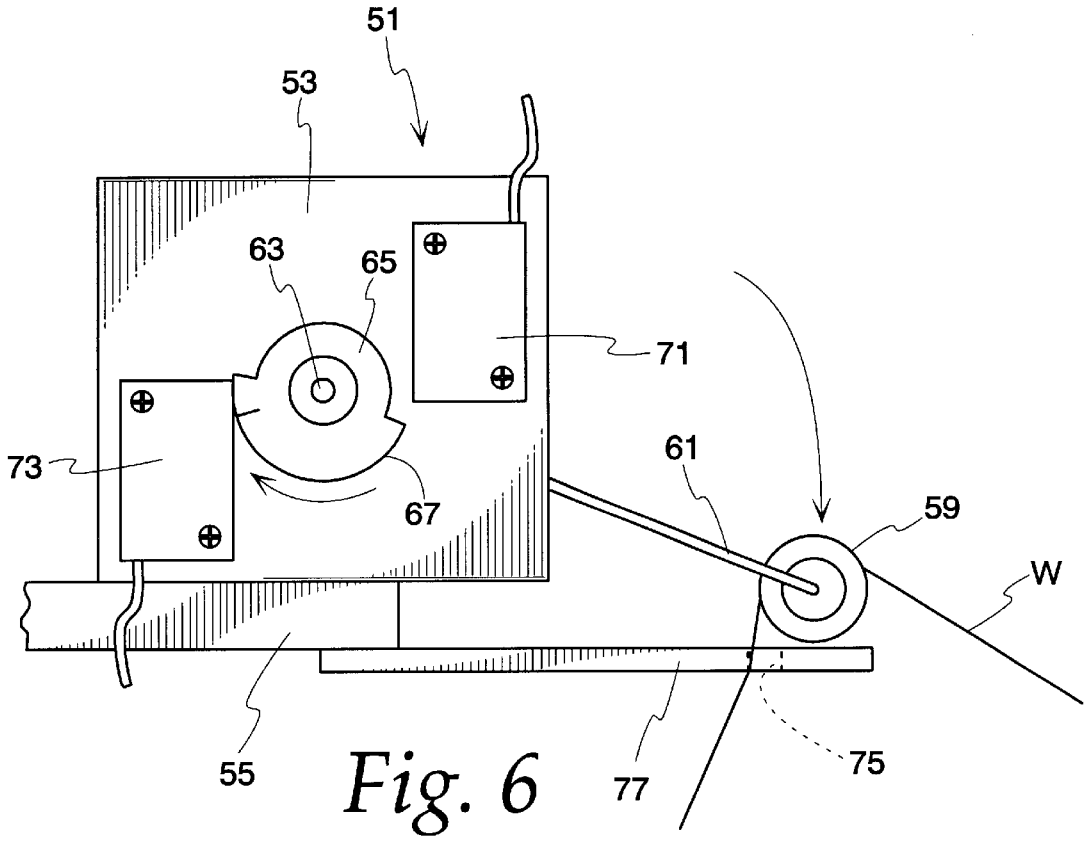
FIG. 6 is a view similar to FIG. 5 but showing the tension measuring mechanism in a moved position.

As can be best seen in FIG. 1 of the drawings, a wire guide 43 is mounted near the upper end of post 17 to guide the wire W as it uncoils from the spool 27. A wire tensioning device 51 is attached to an upstanding plate 53 mounted on a beam 55 cantileveredly extending from and attached to a clamp 57 mounted at the upper end of post 17. A sheave 59 is rotatably mounted on the end of an arm 61 which is attached to a shaft 63 rotatably mounted on the plate 53 as can be best seen in FIGS. 1, 5 and 6 of the drawings. The shaft 63 has a rotor 65 mounted thereon. The rotor includes a lobe formed integrally therewith. As shown most clearly in FIGS. 1, 5 and 6 of the drawings, the rotor 65 is located between proximity switches 71 and 73 which are attached to the upstanding plate 53. As can best be seen in FIG. 5 of the drawings, the arm 61 and its sheave 59 are biased in an upwardly direction by a spring (not shown) to lift the wire W upwardly through a passage hole 75 located in an arm 77 which extends outwardly from the beam 55.

A filament tensioning assembly 81 is shown in position on the wire spool 27 in FIG. 1 and in exploded detail in FIGS. 3 and 4 of the drawings. It includes a pin support plate 83 which has a hexagonal opening, which is not shown, adapted to fit over the hexagonal head 35 of tube 33 so that the plate 83 will remain stationary relative to the tube 33. The plate 83 has a plurality of upstanding pins arranged in a circle and alternating in length between long pins 87 and short pins 89.

A filament disk 101, shown in detail in FIGS. 3 and 4 of the drawings, has a square opening 103 to receive rectangular head 37 at the end of twist shaft 31. This disk includes radially extending resilient flexible filaments 105 which extend outwardly between the pins 87 and 89 on the pin plate 83 when the disk 101 is placed on the plate 83. A top plate 107 is formed with an enlarged center opening 109 to receive the rectangular head 37 of the twist shaft 33 to be clear of contact with the head 37 so it does not rotate with the head 37. A plurality of pin receiving holes 111 are formed in the plate 107 to fit over the pins 87 and 89 as shown in FIG. 1 of the drawing. The top plate 107 functions to hold down the filaments 105.

An insulator 121 is positioned on top of base plate 19 as shown in FIGS. 1 and 2 of the drawings. Located on top of the insulator is a capacitor 123 and relays 125 and 127. The capacitor and relays are connected by wires to a capacitor start motor 131 which is supported on a suspended lower motor support base 133 which is connected to an upper suspended motor support plate 135 by posts 137. The electric motor output shaft (not shown) connects to a reduction gear 141 having an output shaft 143 connected to a flexible coupling 145. The other end of the flexible coupling connects to the twist shaft 31.

An arm 151 is fastened to the twist shaft 31 for rotation therewith. It extends outwardly beyond the support plate 21 where a pointer 153 is provided on the end of the arm to skirt the edge of the support plate 21 and indicate twisting of the head 37. Limit switches 157 and 159 are provided on opposite ends of the travel arc of the arm 151 as shown most clearly in FIGS. 1 and 2 of the drawings. The limit switches control the flow of electricity at standard voltage to the electric motor 131 with one switch controlling the rotation of the motor in one direction and the other switch controlling the rotation of the motor in the other direction.

The use, operation and function of this invention are as follows:

The wire W which is to be uncoiled from the spool 27 is pulled between the filaments 105 of the filament disk 101 as guided by the loop wire guide 43, through the passage 77 in the arm 75 and over the sheave 59 mounted on the arm 61. The wire W is then pulled onto a coil, transformer or other object around which it is wound. As the wire W is unwound from the reel 27 over the axial end thereof, it will engage the filaments 105 and bend these filaments in the direction of uncoiling of the wire. Because the filaments extend between the posts 87 and 89 of the plate 83, the action of the wire against the filaments, which is radially outwardly of the posts 87 and 89, will cause the filaments to bend around the posts 87 and 89. The bending of the filaments will reduce the friction or tension on the wire W during its uncoiling movement.

As the speed of uncoiling of the wire W increases, the drag or friction caused by the filaments 105 will normally increase. However, the drag on the wire W will be reflected, in the rotation of the sheave 59 and arm 61 from the upward position shown in FIGS. 1 and 5 to the lowered position shown in FIG. 6 of the drawings. Movement of the arm 61 will result in rotation of its shaft 63 and affixed rotor 65 from the position shown in FIG. 5 where the lobe 67 is actuating the proximity switch 71 to the position shown in FIG. 6 where the lobe 67 of the rotor 65 actuates the proximity switch 73. When the rotor 65 is in the position shown in FIG. 5, the arm 151 is in contact with limit switch 157 shutting off the flow of electricity to the motor 131. As tension increases in the wire W, the sheave 59 and its arm 61 are rotated in a clockwise direction as viewed in FIG. 5 moving the lobe 67 of the rotor 65 out of proximity with the switch 71 and into proximity with the switch 73. This allows the motor 131 to rotate in a clockwise direction as viewed in FIG. 1 of the drawings since the proximity switch 73 is actuated and its limit switch 159 is open. Rotation of the motor 131 through the reduction gear 141 rotates the twist shaft 31. The twist shaft 31 turns with its square head 37 thereby rotating the filament disk 101 in a clockwise direction as shown by the arrow in FIG. 4 of the drawings. Rotation of the filament disk 101 will bend the outer ends of the filaments about the pins 87 and 89 in the uncoiling direction of the wire W to reduce the tension or drag on the uncoiling wire W. As long as the arm 151 is out of contact with either of the limit switches 157 or 159, the motor 131 will continue to run with its direction of rotation controlled by one of the proximity switches 71 or 73, which ever switch is actuated by the rotor lobe 67. Thus, as the tension on the wire W changes, the arm 61 will move upwardly and downwardly, rotating the lobe 67 and rapidly changing the direction of rotation of the motor 131 and the direction of twist of the head 37.

What is claimed is:

1. A wire tensioning device for maintaining tension on a moving wire as the wire is uncoiled over the axial end of a fixed spool of wire including:

a disk adapted to be mounted on the axial end of a spool of wire, said disk having a plurality of radially extending resilient filaments that protrude beyond the periphery of the axial end of the spool of wire, said filaments engaging said wire as it is unwound from said spool over said axial end of said spool to thereby apply a resistance to the uncoiling of said wire, a drive shaft powered by a reversible motor for rapidly responding to changes in said resistance applied to said uncoiling wire by bending or unbending of said filaments, said disk operably connected to said drive shaft, an arm engaged by said uncoiling wire, said arm connected to a rotatably mounted axle for pivotal movement in a limited arc, a rotor mounted on said axle, a lobe formed on said rotor, a pair of proximity switches for operating said reversible electric motor in opposite directions of rotation, one of said pair of said proximity switches positioned on each of diametrically located opposite sides of said rotor, said proximity switches positioned relative to said rotor to position said lobe in actuating proximity to only one of said pair of proximity switches during rotation of said axle in response to pivotal movement of said arm within said limited arc.

2. The wire tensioning device of claim 1 in which an indicator arm is connected to said drive shaft for rotation in an arc with said drive shaft, a pair of limit switches positioned at opposite ends of an arc of travel of said indicator arm, and said limit switches controlling the supply of electricity to said reversible electric motor.

* * * * *